US008170452B2

(12) United States Patent
Tamura

(10) Patent No.: US 8,170,452 B2
(45) Date of Patent: May 1, 2012

(54) DEVELOPER SUPPLYING UNIT

(75) Inventor: Masashige Tamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 12/785,866

(22) Filed: May 24, 2010

(65) Prior Publication Data

US 2010/0303508 A1 Dec. 2, 2010

(30) Foreign Application Priority Data

Jun. 1, 2009 (JP) ..... 2009-131730

(51) Int. Cl.
*G03G 15/08* (2006.01)

(52) U.S. Cl. ..... 399/258; 399/262

(58) Field of Classification Search ..... 399/258, 399/262; 222/DIG. 1
See application file for complete search history.

(56) References Cited

U.S. PATENT DOCUMENTS

| | | | | |
|---|---|---|---|---|
| 5,598,254 | A * | 1/1997 | Ikesue et al. | 399/262 |
| 6,118,951 | A * | 9/2000 | Kato et al. | 399/258 X |
| 6,879,789 | B2 | 4/2005 | Yamada et al. | |
| 6,920,298 | B2 | 7/2005 | Yamada et al. | |
| 6,944,417 | B2 | 9/2005 | Yamada et al. | |
| 6,990,301 | B2 | 1/2006 | Yamada et al. | |
| 7,006,775 | B2 | 2/2006 | Doi et al. | |
| 7,016,630 | B2 | 3/2006 | Yoshizaki et al. | |
| 7,039,347 | B2 | 5/2006 | Yamada et al. | |
| 7,113,731 | B2 | 9/2006 | Horikoshi et al. | |
| 7,116,931 | B2 | 10/2006 | Yamada et al. | |
| 7,127,193 | B2 | 10/2006 | Yamada et al. | |
| 7,324,777 | B2 | 1/2008 | Yamada et al. | |
| 7,376,369 | B2 | 5/2008 | Yamada et al. | |
| 7,382,997 | B2 | 6/2008 | Yamada et al. | |
| 7,386,251 | B2 | 6/2008 | Yamada et al. | |
| 7,430,384 | B2 | 9/2008 | Yamada et al. | |
| 7,433,633 | B2 | 10/2008 | Yamada et al. | |
| 7,469,113 | B2 | 12/2008 | Yamada et al. | |
| 7,474,866 | B2 | 1/2009 | Doi et al. | |
| 7,647,012 | B2 | 1/2010 | Yamada et al. | |
| 2005/0175376 | A1 * | 8/2005 | Sekiguchi | 399/258 |
| 2010/0046982 | A1 | 2/2010 | Yamada et al. | |
| 2010/0111560 | A1 | 5/2010 | Yamada et al. | |
| 2010/0111561 | A1 | 5/2010 | Yamada et al. | |
| 2010/0111573 | A1 | 5/2010 | Yamada et al. | |

FOREIGN PATENT DOCUMENTS

| | | | |
|---|---|---|---|
| JP | 2002-318490 | A | 10/2002 |
| JP | 2004-325841 | A | 11/2004 |
| JP | 3884973 | B2 | 11/2006 |

* cited by examiner

*Primary Examiner* — Sophia S Chen
(74) *Attorney, Agent, or Firm* — Patrick, Cella, Harper & Scinto

(57) ABSTRACT

A developer supplying unit of the present invention includes a first driving mechanism which transmits rotational driving to a drive shaft by rotating a first rotational shaft in a normal direction and a second driving mechanism which reciprocates a bottle holding member as a support member to support a toner replenishment unit between a first position within an apparatus main body and a second position being different from the first position by rotating the first rotational shaft in a reverse direction.

7 Claims, 6 Drawing Sheets

PRIOR ART

DEVELOPER SUPPLYING UNIT

BACKGROUND OF THE INVENTION

1. Field of the Invention

The present invention relates to a developer replenishment unit which is used for an image forming apparatus such as a copying machine, a facsimile machine and a printer having a developer device to form an image on an image bearing member with developer, for example.

2. Description of the Related Art

In an electrographic image forming apparatus such as a copying machine and a printer in the related art, fine powder toner has been used as developer. Then, when toner in the electrographic image forming apparatus main body is consumed, toner has been replenished to the image forming apparatus main body by utilizing a toner replenishment container as a developer storage container. Since toner is extremely fine powder, a method to discharge toner by small amounts from a small opening portion while the toner replenishment container is placed at the inside of the image forming apparatus main body so as to prevent toner scattering has been known for the toner replenishment operation.

For example, in FIG. 7 of Japanese Patent Application Laid-open No. 2002-318490, a driving portion is provided to rotationally drive the toner bottle in the circumferential direction as being connected to the toner bottle. The driving portion is rotatably supported by a bearing and is rotationally driven by a driving motor (not illustrated) disposed in the apparatus main body.

When the rotational driving motor (not illustrated) is actuated in a state being capable of replenishing toner while an opening portion is opened as a sealing member departs from the toner bottle, rotational driving force is transmitted from the driving portion of the apparatus main body to a driving force receiving face as a driving force receiving portion of an engaging projection of the sealing member. Then, as the rotational driving force is further transmitted from the sealing member to a drive shaft, the toner bottle is rotated and toner is conveyed and discharged.

Further, a mechanism to linearly reciprocate the toner bottle (or a bottle holding member to hold the toner bottle) is illustrated in FIGS. 9 and 10 of Japanese Patent Application Laid-open No. 2004-325841. With the technologies of Japanese Patent Application Laid-open No. 2002-318490 and Japanese Patent Application Laid-open No. 2004-325841, rotational driving of the toner bottle in the circumferential direction and reciprocating driving of the toner bottle in the axial direction can be automatically performed. However, since two motors are necessary as the respective driving sources, there has been a problem of apparatus upsizing.

In the related art as described above, a container rotating mechanism for toner replenishment and a container detachably attaching mechanism are provided. Then, in a case that the respective driving mechanisms are automatically operated for apparatus simplification, two motors are to be necessary. Accordingly, there has been a problem of upsizing.

SUMMARY OF THE INVENTION

To address this issue, the present invention is devised to suppress apparatus upsizing and cost increase. The present invention provides a developer supplying unit having attaching exchangeability of a developer storage container with high reliability and high user operability.

According to the present invention, there is provided a developer supplying unit including:

a container which stores developer;

a support member which supports the container;

a conveying portion which conveys developer in the container toward an opening portion arranged at the container by being rotationally driven;

an open/close member which opens and closes the opening portion;

a driving source which includes an output shaft capable of switching the rotational direction thereof;

a first mechanism which rotates the conveying portion by rotating the output shaft in a normal direction; and a second mechanism which reciprocates the open/close member relatively against the opening portion by rotating the output shaft in a reverse direction.

Further features of the present invention will become apparent from the following description of exemplary embodiments with reference to the attached drawings.

DESCRIPTION OF THE EMBODIMENTS

In the following, exemplary embodiments of the present invention will be described in detail in an exemplified manner with reference to the drawings. Here, dimensions, materials, shapes and relative arrangement of structural components described in the following embodiments do not limit the scope of the present invention, unless otherwise specified.

First Embodiment

An image forming apparatus having a developer replenishment unit according to the present invention will be described in detail with reference to the drawings.

Figure 3:
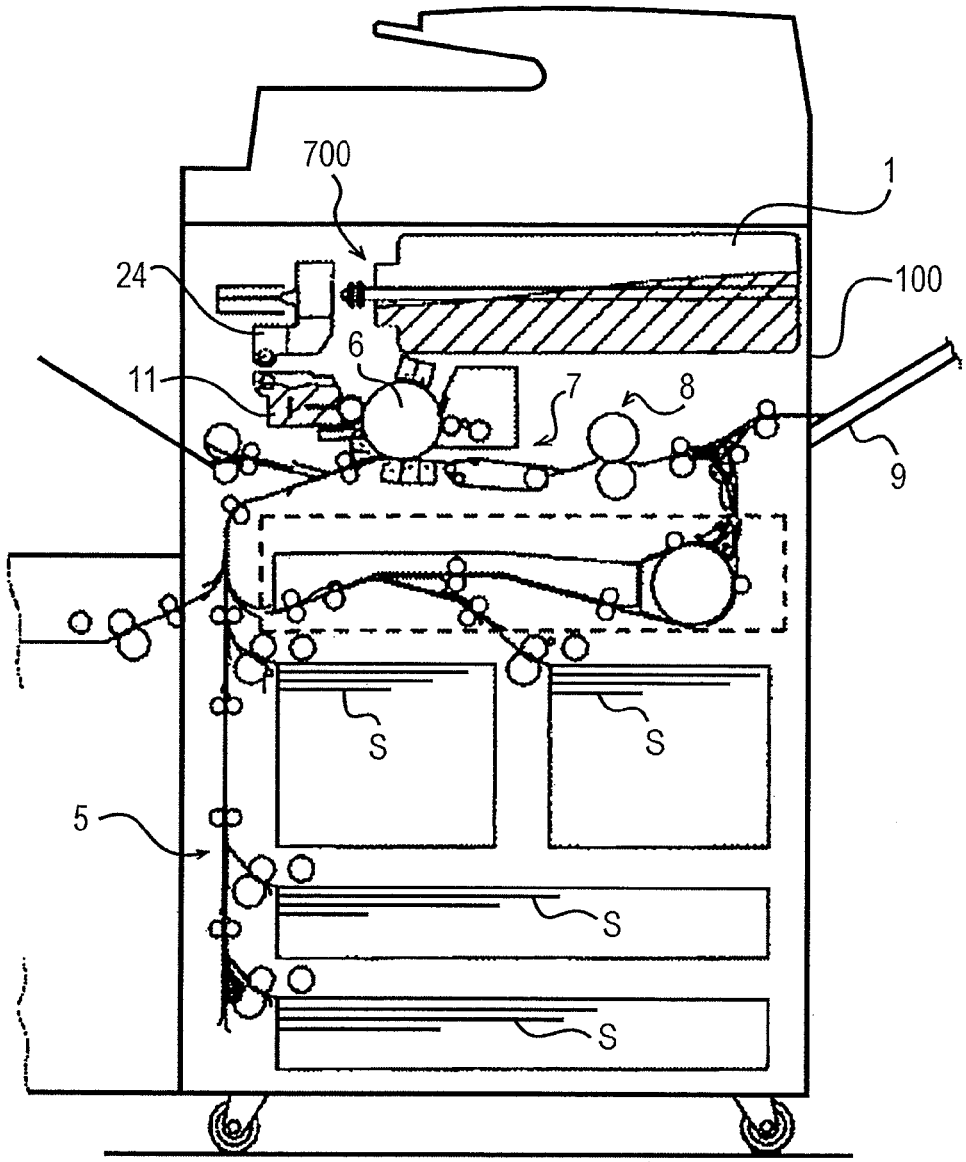
FIG. 3 is an explanatory front view of an image forming apparatus according to the embodiment of the present invention.

FIG. 3 is a schematic front view of an image forming apparatus main body 100. A toner replenishment unit 700 is a container to store developer and constitutes a developer supplying unit as a conveying portion to convey developer in the container toward an opening portion 1*a* arranged at the container by being rotationally driven. In the toner replenishment unit 700, a toner bottle 1 as a developer storage container is arranged horizontally and laterally in the apparatus main body 100. Toner as the developer discharged from the toner bottle 1 is fed to a development device 11 after being once stored in a hopper 24 as a developer receiving container. With the toner fed to the development device 11, a toner image is formed at an image forming portion 7 having a photosensitive drum 6 as an image bearing member. Meanwhile, the toner image formed at the image forming portion 7 is transferred to a sheet S selectively fed from a feeding portion 5 and fixed by being passed through a fixing portion 8. Then, the sheet S is discharged to a discharge tray 9.

Figure 2A:
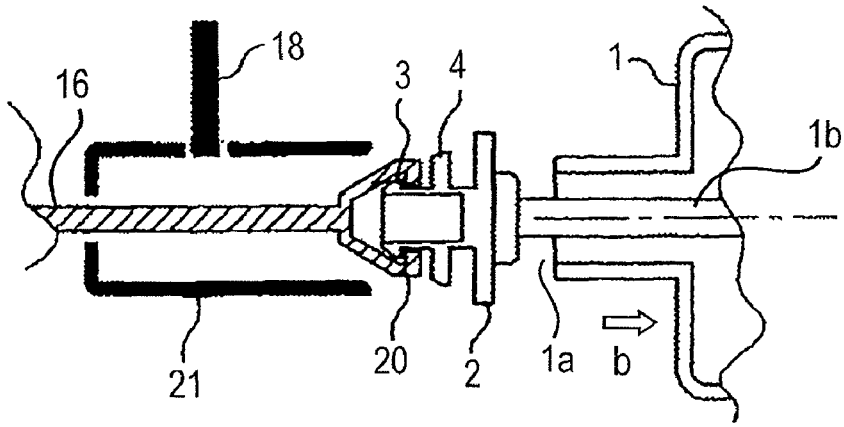
FIGS. 2A, 2B and 2C are sectional schematic views of the developer supplying unit according to the embodiment of the present invention.
Figure 2B:
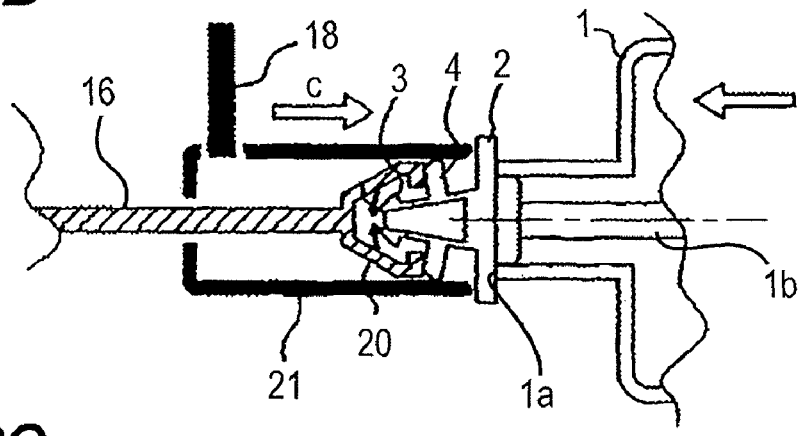
Figure 2C:
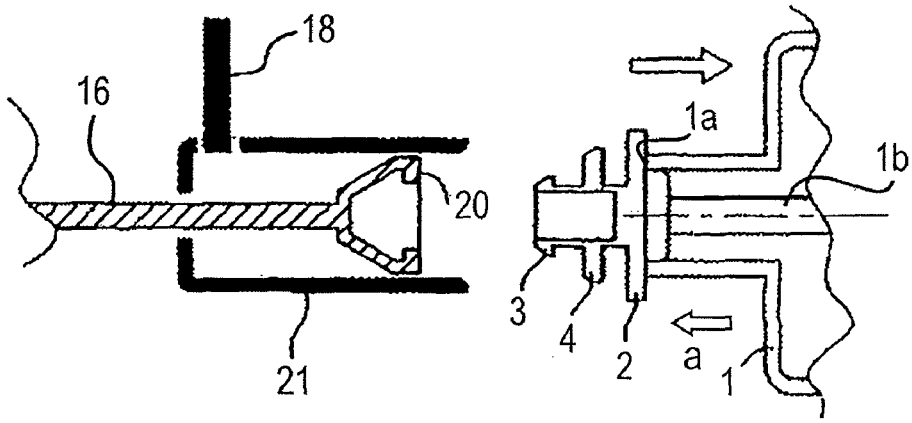

FIG. 2 schematically illustrates the toner replenishment unit 700 which is to be attached to the apparatus maid body 100. In the present embodiment, the toner bottle 1 as the developer storage container and an open/close controlling member 21 performs reciprocating operation in a direction of a rotational drive shaft 1*b* as the conveying portion of the toner bottle 1 (i.e., in directions of arrows a, b in FIGS. 2A and 2C). In the present embodiment, the rotational drive shaft 1*b* is used as the conveying portion to convey toner in the toner bottle 1. However, it is also possible to convey toner by arranging a conveying portion at an inner face of a toner bottle and rotating the toner bottle, for example.

Then, with the reciprocating operation of the toner bottle 1, the toner bottle 1 as the developer storage container which stores developer inside is attached to and detached from a casing of the image forming apparatus main body 100. Further, a first driving mechanism is arranged to unseal and seal the opening portion 1*a* of the toner bottle 1 by reciprocating the open/close controlling member 21 being interlocked with the reciprocating operation of the toner bottle 1. Accordingly, it is configured to be capable of placing the toner bottle 1 into a replenishment allowed state, releasing from the replenishment state and retracting to a bottle detachably attachable position.

In the following, description is performed on operation of the open/close controlling member 21 which is characteristic to the present embodiment, moving drive operation of the toner bottle 1 and rotating drive operation to discharge toner from the toner bottle 1. In particular, a drive transmitting method performed by utilizing a rotational driving motor M as a single driving source will be described in detail with reference to the drawings.

Figure 1:
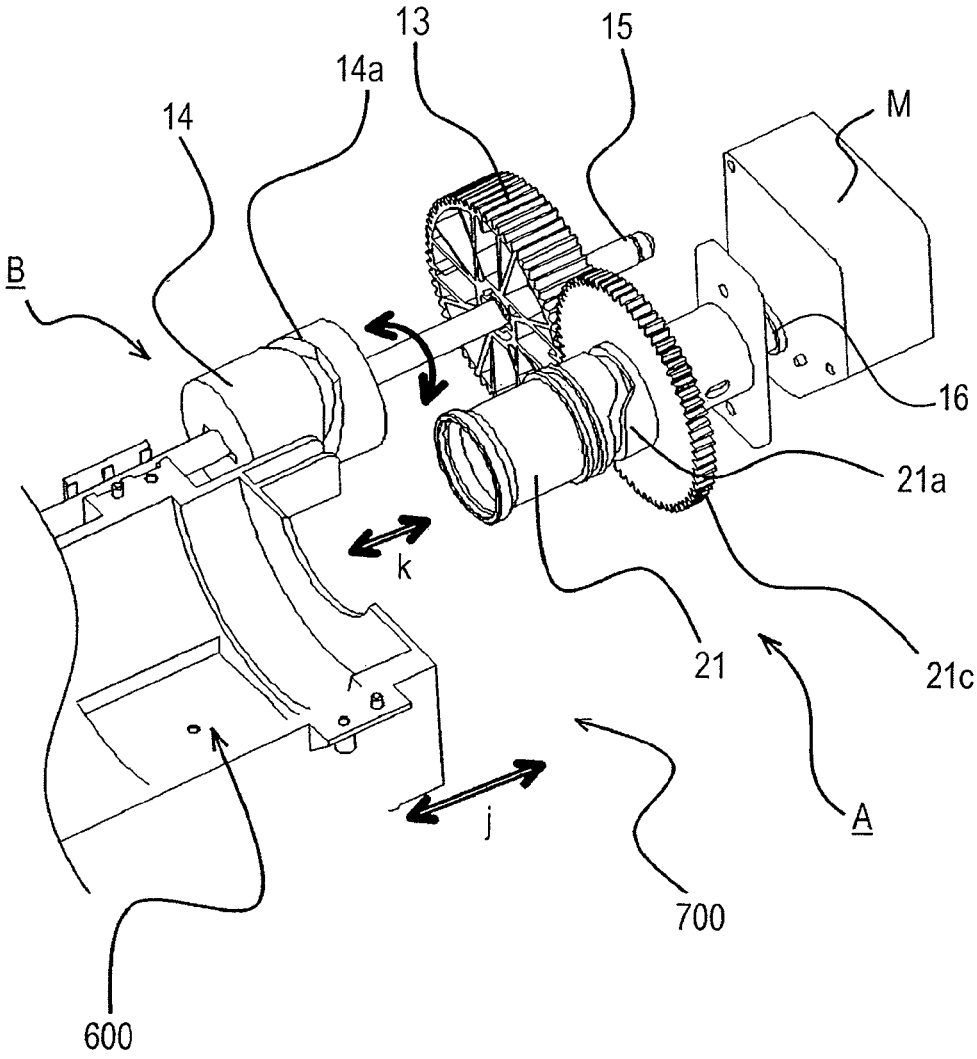
FIG. 1 is a perspective view of a developer supplying unit according to an embodiment of the present invention.

FIG. 1 illustrates the first driving mechanism A which attaches and detaches the toner bottle 1 as the developer storage container storing developer therein to and from the casing of the apparatus main body 100 and which unseals and seals the opening portion 1*a* of the toner bottle 1. Further, a second driving mechanism B is arranged to agitate and discharge developer stored at the inside of the toner bottle 1. FIG. 1 is a perspective view illustrating an example of a mechanism to perform the above-mentioned operation by utilizing the rotational driving motor M as the single driving source capable of driving both of the abovementioned mechanisms.

As illustrated in FIG. 1, a rotational shaft 15 rotatably and axially supported by the casing (not illustrated) is provided with a leading cam 14 as the second driving mechanism to linearly reciprocate a bottle holding member 600. A whole circumferential cam groove 14*a* which is rotated in one direction is formed at the leading cam 14 arranged at the rotational shaft 15, so that the bottle holding member 600 is linearly reciprocated in the direction of arrow j in FIG. 1.

Figure 4:
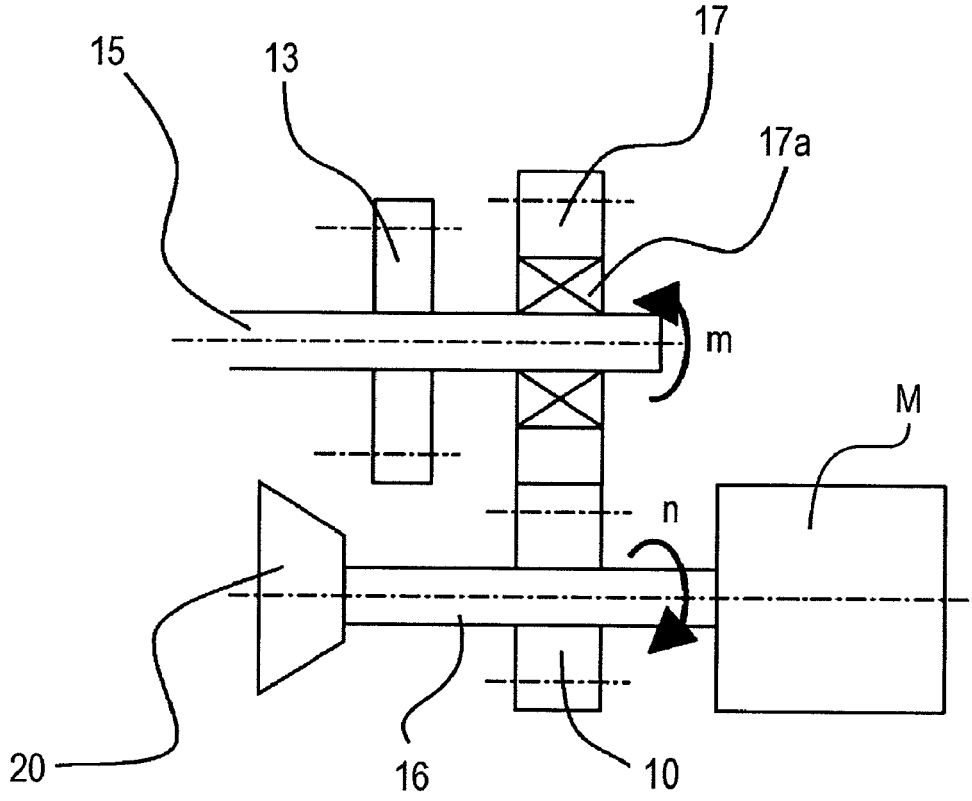
FIG. 4 is a view which illustrates a part of a driving system of the developer supplying unit according to the embodiment of the present invention.

When an one-way clutch gear 17 as a second gear illustrated in FIG. 4 is driven, the leading cam 14 as the second driving mechanism in FIG. 1 moves the bottle holding member 600 as a support member to support the toner replenishment unit 700 which constitutes the container to the first position of the image forming apparatus main body 100 (i.e., within the apparatus main body) as illustrated FIG. 2B, and then, moves the bottle holding member 600 to the second position being different from the first position as illustrated in FIG. 2A. The leading cam 14 as the second driving mechanism in FIG. 1 includes the second rotational shaft 15 fitted to the one-way clutch gear 17 as the second gear in FIG. 4. Then, the leading cam 14 constitutes a cam mechanism to perform reciprocating movement in the direction of the second rotational shaft 15 (i.e., in the second rotational axial direction) by being engaged with an engaging projection 18 which is fixed to the apparatus main body 100 in FIG. 2 and being rotationally driven. Further, by driving the one-way clutch gear 17 as the second gear, the leading cam 14 as the second driving mechanism moves a sealing member 2 as an open/close member to open and close the opening portion 1*a* in FIG. 2 to a position of FIG. 2B where the opening portion 1*a* is closed. Then, the sealing member 2 is moved to a position of FIG. 2A where the opening portion 1*a* is opened. By the movement of the bottle holding member 600, the sealing member 2 as the open/close member is relatively moved respectively to the position of FIG. 2B to close the opening portion 1*a* and the position of FIG. 2A to open the opening portion 1*a*. The one-way clutch gear 17, the one-way clutch 17*a*, a whole circumferential gear 10 and a driving portion 20 are abbreviated from FIG. 1, and then, the leading cum 14, the open/close controlling member 21 and a whole circumferential gear 21*c* are abbreviated from FIG. 4.

Further, as illustrated in FIG. 1, a drive transmitting gear 13 having a gear formed at the whole circumference thereof is arranged at the rotational shaft 15, and then, is mated with the whole circumferential gear 21*c* integrally formed with the open/close controlling member 21. The rotational driving force is transmitted from the rotational driving motor M as the driving source to the open/close controlling member 21 having the whole circumferential cam groove 21*a* and the whole circumferential gear 21*c*. FIGS. 1 and 4 illustrate the configuration that a first rotational shaft 16 connected to an output shaft of the rotational driving motor M transmits driving to the whole circumferential gear 10. Further, the rotational driving force is transmitted to the one-way clutch gear 17, the one-way clutch 17*a*, the second rotational shaft 15, the drive transmitting gear 13 and the whole circumferential gear 21*c* by the rotational driving transmitted to the whole circumferential gear 10.

The open/close controlling member 21 is arranged coaxially with the driving portion 20 and is axially supported being relatively rotatable against the driving portion 20. Therefore, even when the driving portion 20 is rotated, the open/close controlling member 21 will not be rotated. As illustrated in FIG. 4, the driving portion 20 as the first driving mechanism is provided with the first rotatable rotational shaft 16 to transmit rotational driving to the rotational driving shaft 1*b* of the toner replenishment unit 700 as the conveying portion. Then, by inputting driving force for rotating in the normal direction to the first rotational shaft 16, the rotational drive shaft 1*b* of the toner replenishment unit 700 as the conveying portion is driven to rotate.

The driving system view of FIG. 4 illustrates the configuration that the rotational driving of the rotational shaft 15 is obtained from the rotational driving motor M as the driving source utilized for toner discharging from the toner bottle 1 and rotational driving. The rotational driving motor M as the driving source is actuated to be capable of switching the rotational direction of the first rotational shaft 16.

As the feature of the present embodiment, the rotational driving motor M as the driving source is controlled in normal and reverse directions. With this configuration, the rotational driving in the circumferential direction to discharge toner from the toner bottle 1 as the container and the reciprocating linear driving in the axial direction to attach and detach the toner bottle 1 (i.e., including open/close operation of the sealing member 2 as the open/close member) can be controlled.

The configuration to obtain rotational driving against the leading cam 14 and the open/close controlling member 21 from the rotational driving motor M used for toner discharging, from the toner bottle 1 and rotational driving will be described with reference to FIG. 4.

The whole circumferential gear 10 as the first gear is arranged on the first rotational shaft 16 which is connected to the output shaft of the rotational driving motor M for toner discharging and rotational driving and is supported to be rotated in synchronization with the driving portion 20. Further, the one-way clutch gear 17 axially supported to the rotational shaft 15 and mated with the whole circumferential gear 10 is arranged at the rotational shaft 15, and then, the one-way clutch 17*a* is integrally arranged as an one-direction drive transmitting member. Accordingly, the one-way clutch gear 17 is arranged as the second gear which applies rotational driving when the whole circumferential gear 10 is rotated in one direction and which does not applies rotational driving when the whole circumferential gear 10 is rotated in the other direction. In the present embodiment, when the rotational driving motor M is rotated in the direction reverse to arrow n in FIG. 4, rotation is generated so that toner is discharged from the toner bottle 1. At that time, the one-way clutch 17*a* is rotated at idle, so that the rotational shaft 15 will not be rotated. On the contrary, when the rotational driving motor M is rotated in the direction of arrow n in FIG. 4, the one-way clutch 17*a* transmits rotation to the rotational shaft 15. Accordingly, the rotational shaft 15 is rotated in the direction of arrow m in FIG. 4, so that the leading cam 14 as the second driving mechanism in FIG. 1 is rotated. Meanwhile, the engaging projection 18 in FIG. 2 is fixed on the casing in a non-moving state. Then, the whole circumferential cam groove 21*a* formed on the outer circumferential face of the open/close controlling member 21 is configured to be engaged with the engaging projection 18. That is, the first driving mechanism A is arranged to attach and detach the toner bottle 1 as the developer storage container to and from the casing of the apparatus main body 100 and to unseal and seal the opening portion 1*a* of the toner bottle 1. The first driving mechanism A is provided with a whole circumferential cam mechanism being movable in the axial direction as the engaging projection 18 fixed at the non-movable position of the casing is engaged with the whole circumferential cam face of the whole circumferential cam groove 21*a*. Accordingly, by rotating the open/close controlling member 21 while the whole circumferential cam groove 21*a* is engaged with the non-movable engaging projection 18 formed on the casing of the apparatus main body 100, the open/close controlling member 21 is moved back and forth in the direction of arrow k in FIG. 1.

That is, in the present embodiment, one rotational direction of the rotational driving motor M as the single driving source is utilized for driving the second driving mechanism B to agitate and discharge developer stored at the inside of the toner bottle 1 as the developer storage container. Then, the other rotational direction of the rotational driving motor M is utilized for driving the first driving mechanism A to attach and detach the toner bottle 1 to and from the casing of the apparatus main body 100 and to unseal and seal the opening portion 1*a* of the toner bottle 1.

Here, the present embodiment includes the one-direction drive transmitting member capable of transmitting the driving force from the rotational driving motor M as the single driving source selectively to the first and second driving mechanisms A, B. The one-way clutch gear 17 incorporating the one-way clutch 17*a* is described as an example of the one-direction drive transmitting member. However, as long as the similar effects can be obtained, the position of placing the one-way clutch 17*a* is not limited to the above. Similarly, the rotational direction of each driving portion is not limited, as well.

That is, in the present embodiment, the rotational driving motor M as the single driving source is driven selectively in the normal direction or the reverse direction. Then, the driving force transmitted from the rotational driving motor M as the single driving source is transmitted selectively to the first and second driving mechanisms A, B by the one-way clutch gear 17 which incorporates the one-way clutch 17*a* as the one-direction drive transmitting member. With this configuration, the driving force from the rotational driving motor M as the driving source can be transmitted only to the second driving mechanism B which agitates and discharges developer stored in the toner bottle 1 as the developer storage container. Then, the driving force can be transmitted to the first driving mechanism A which attaches and detaches the toner bottle 1 to and from the casing of the apparatus main body 100 and unseals and seals the opening portion 1*a* of the toner bottle 1. The transmission can be selectively determined from the above.

In the following, the operation of releasing from the replenishing state of the toner bottle 1 and retracting to the bottle detachably attachable position are sequentially described with reference to FIG. 5.

Figure 5:
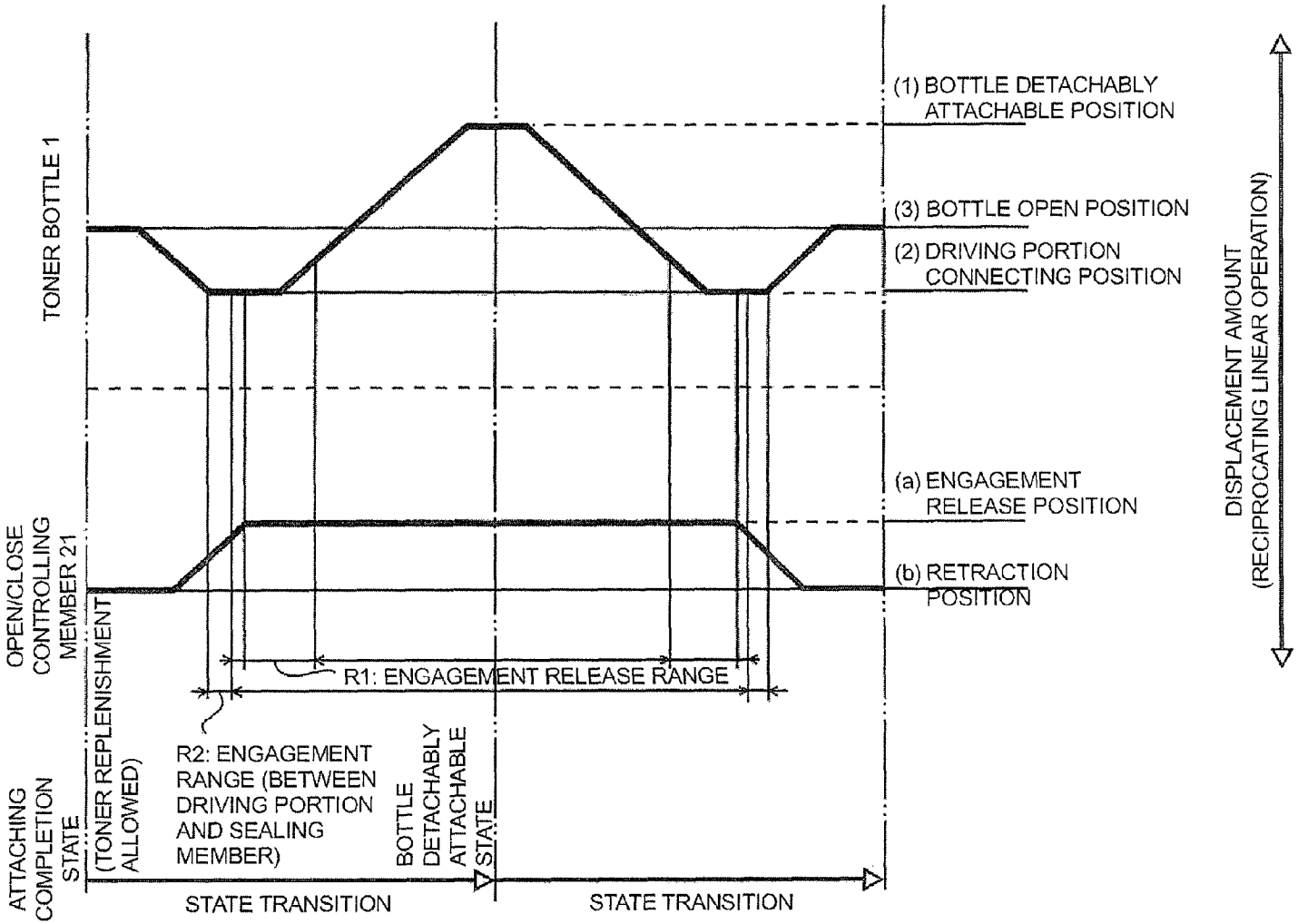
FIG. 5 is a locus explanatory chart which indicates displacement of a developer storage container and an open/close controlling member according to the embodiment of the present invention.

FIG. 5 illustrates the transition process between "the detachably attachable state" and "the attaching completion state" with a sequence of operation of the rotational driving motor M. In particular, FIG. 5 illustrates loci of the displacement amounts of the toner bottle 1 and the bottle holding member 600 to hold the toner bottle 1 and the open/close controlling member 21 in the direction of the rotational driving shaft 1*b* of the toner bottle 1.

The open/close controlling member 21 is at an engagement release position (a) in FIG. 5 in "the detachably attachable state". Then, the operation/close controlling member 21 proceeds to the lower direction of the displacement amount in FIG. 5 (i.e., the opposite direction to arrow c in FIG. 2B) in the process toward "the attaching completion state" and is moved to the retraction position (b) in FIG. 5. On the contrary, in the transition process from "the attaching completion state" toward "the detachably attachable state", the locus opposite to the above is traced.

Meanwhile, the toner bottle 1 is at a bottle detachably attachable position (1) in FIG. 5 in "the detachably attachable state". Then, in the process of proceeding toward "the attaching completion state", the toner bottle 1 once proceeds to the lower direction of the displacement amount in FIG. 5 (i.e., the direction of arrow a in FIG. 2C) until a driving portion connecting position (2) in FIG. 5 and stops. Subsequently, the toner bottle 1 proceeds to the upper direction of the displacement amount in FIG. 5 (i.e., the direction of arrow b in FIG. 2A) once again and is moved to a bottle open position (3) in FIG. 5 in "the attaching completion state". On the contrary, in the transition process from "the attaching completion state" toward "the detachably attachable state", the locus opposite to the above is traced.

In the following, the relation among respective members at each position in both of the displacement loci is specifically described in order once again. At the time of transition from "the detachably attachable state" to "the attaching completion state", first, the toner bottle 1 is at the bottle detachably attachable position (1) in FIG. 5. At this position, the toner bottle 1 can be freely attached to and detached from the apparatus main body 100 by a user. Then, the toner bottle 1 is moved to the driving portion connecting position (2) in FIG. 5 and remains stopped for a predetermined time. At that time, the position of the toner bottle 1 corresponds to the abovementioned position indicated in FIG. 2B. At the time when the toner bottle 1 is to be stopped at the driving portion connecting position (2) in FIG. 5 (i.e., R1 in FIG. 5, namely, an engagement release range), the open/close controlling member 21 is located at the engagement release position (a) in FIG. 5 (i.e., the state of FIG. 2B). Therefore, engagement of an engaging projection 3 formed at the sealing member 2 with the driving portion 20 as the drive connecting portion which is drive-connected to the sealing member 2 is not completed. Subsequently, the open/close controlling member 21 is moved to the retraction position (b) in FIG. 5 while the toner bottle 1 still remains at the driving portion connection position (2) in FIG. 5. Accordingly, since the pressing pressure of a release projection 4 of the sealing member 2 as the open/close member to open and close the opening portion 1*a* is released, the engagement between the sealing member 2 and the driving portion 20 is completed in the engagement range (i.e., R2 in FIG. 5). Thereafter, the toner bottle 1 is further moved to the bottle open position (3) in FIG. 5 and the sealing member 2 departs from the toner bottle 1. Accordingly, the opening portion 1*a* is opened (i.e., the state indicated in FIG. 2A).

On the contrary, at the time of transition from "the attaching completion state" to "the detachably attachable state", the toner bottle 1 is moved from the bottle open position (3) in FIG. 5 (i.e., the state indicated in FIG. 2A) where the opening portion 1*a* is opened to the driving portion connecting position (2) in FIG. 5 so as to seal (i.e., close) the opening portion 1*a*. Thereafter, the toner bottle 1 is moved once again to the bottle detachably attachable position (1) in FIG. 5 while the open/close controlling member 21 is moved to and remains at the engagement release position (a) in FIG. 5 (i.e., R1 in FIG. 5, namely, within the engagement release range). Therefore, as a result, the toner bottle 1 can be moved to the bottle detachably attachable position (1) in FIG. 5 in a state that the engagement between the sealing member 2 and the driving portion 20 is released (i.e., the transition from FIG. 2B to FIG. 2C).

As described above, according to the present embodiment, operation of releasing from the replenishment state of the toner bottle 1 and operation of retracting to the bottle detachably attachable position can be automatically performed simultaneously by utilizing the rotational driving motor M to convey and discharge toner stored in the toner bottle 1.

Accordingly, compared to a complicated gear series, a linkage mechanism and a closing mechanism, cost reduction can be achieved due to remarkable part count reduction. In addition, upsizing of the apparatus can be suppressed. Further, at the same time, by simplifying the mechanism, unavoidable force being accidental and unexpected occurring at a position where a user directly operates can be easily dealt. Further, reinforcement can be suppressed to the minimum. Accordingly, attaching exchangeability of the toner bottle 1 having high reliability and high user operability can be obtained while suppressing upsizing and cost increasing of the abovementioned apparatus.

In the abovementioned embodiment, a copying machine is exemplified as the image forming apparatus. However, not limited to this, the present invention can be applied to another image forming apparatus such as a printer and a facsimile machine, for example. Further, the present invention can be applied to another image forming apparatus such as a multifunction machine having these functions combined; Further, the present invention can be applied to an image forming apparatus which utilizes a transfer material bearing member to bear transfer material such as a sheet material and sequentially superimposes and transfers toner images of respective colors to the transfer material borne by the transfer material bearing member. Further, the present invention can be applied to an image forming apparatus which utilizes an intermediate transfer member, sequentially superimposes and transfers toner images of respective colors to the intermediate transfer member, and transfers the toner image borne at the intermediate transfer member to a transfer material at one time. Similar effects can be obtained by applying the present invention to the abovementioned image forming apparatuses.

In the abovementioned embodiment, the image forming apparatus having one development device is exemplified as the image forming apparatus. However, not limited to this, the present invention can be applied to an image forming apparatus having a plurality of development devices to perform image forming with developer of different colors, for example. Hence, the present invention can be applied regardless of the number of development devices and similar operational effects can be obtained.

COMPARISON EXAMPLE

Figure 6:
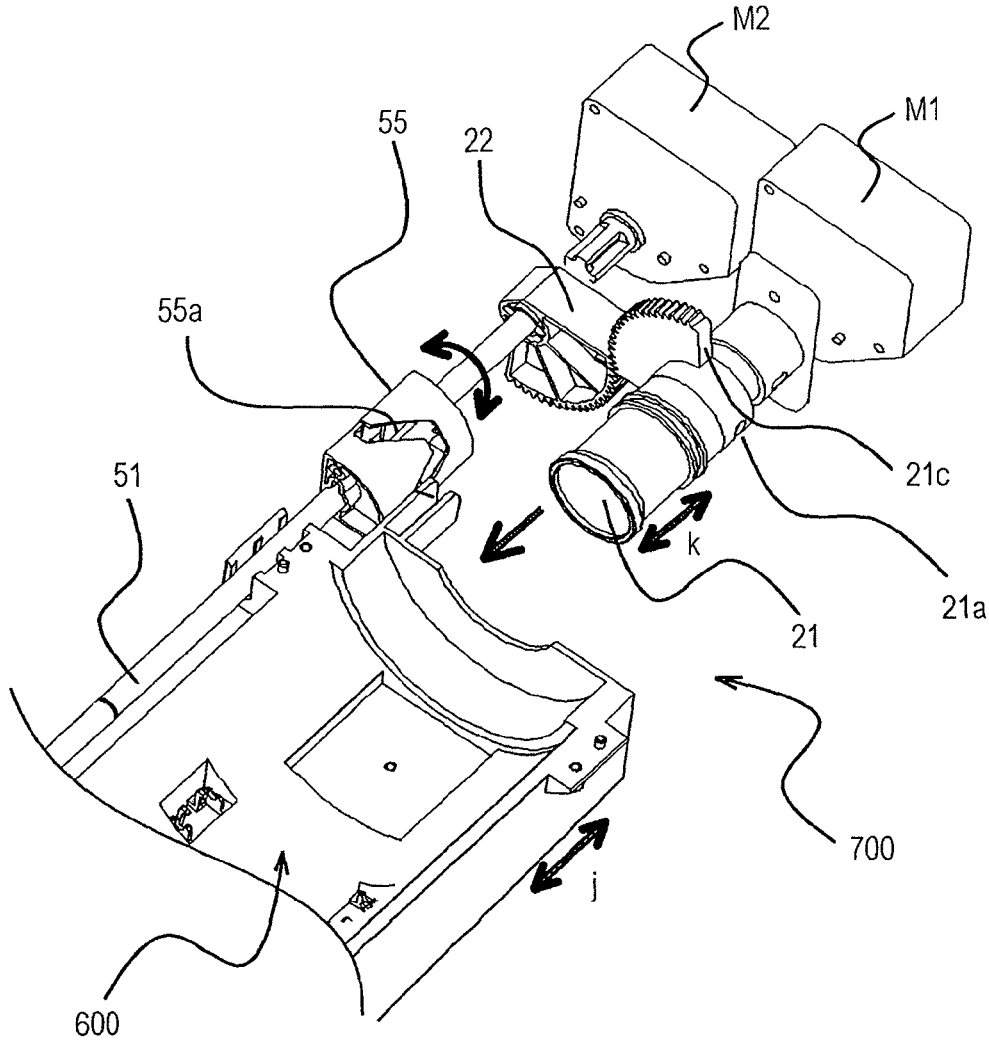
FIG. 6 is a perspective view of a comparison example of a developer supplying unit.

FIG. 6 illustrates an example of a comparison example having the configuration that an end part of a rotational shaft 51 is connected to a rotational driving motor M2 disposed separately from the rotational driving motor M1 connected to the first rotational shaft 16. Due to reciprocating rotational operation of a leading cam 55 by normal and reverse rotational operation of the rotational driving motor M2, the bottle holding member 600 linearly reciprocates as being lead by a cam groove 55*a*. FIG. 6 illustrates a rotational shaft 51 connected to an output shaft of the rotational driving motor M2, a gear 22 fixed to the rotational shaft 51, and a gear 21*c* mated with the gear 22 and integrally formed with the open/close controlling member 21.

The rotational driving motor M1 is connected to the driving portion 20 being similar to the abovementioned embodiment and applies rotational driving to the toner bottle 1. In such a comparison example, rotational driving of the toner bottle 1 in the circumferential direction and reciprocating driving of the toner bottle 1 in the axial direction can be automatically performed, as well. However, two rotational driving motors M1, M2 are necessary as respective driving sources, so that apparatus upsizing is inevitable.

According to the present invention, a single driving source capable of driving the second driving mechanism which agitates and discharges developer stored in a developer storage container is utilized. At the same time, the first driving mechanism which attaches and detaches the developer storage container to and from a casing and unseals and seals an opening portion of the developer storage container can be driven therewith. With this configuration, attaching exchangeability of the developer storage container having high reliability and high user operability can be obtained while suppressing apparatus upsizing and cost increase.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims, the benefit of Japanese Patent Application No. 2009-131730, filed Jun. 1, 2009, which is hereby incorporated by reference herein in its entirety.

What is claimed is:

1. A developer supplying unit comprising:

a container which stores developer;

a support member which supports the container;

a conveying portion which conveys developer in the container toward an opening portion arranged at the container by being rotationally driven;

an open/close member which opens and closes the opening portion;

a driving source which includes an output shaft capable of switching a rotational direction thereof;

a first mechanism which rotates the conveying portion by rotating the output shaft in a normal direction; and a second mechanism which reciprocates the open/close member relatively against the opening portion by rotating the output shaft in a reverse direction.

2. The developer supplying unit according to claim 1, wherein the second mechanism includes an one-way gear with which driving from the output shaft is not transmitted when the output shaft is rotated in the normal direction and driving from the output shaft is transmitted when the output shaft is rotated in the reverse direction.

3. The developer supplying unit according to claim 2, wherein the second mechanism includes a rotational shaft to be rotated by the one-way gear and a cam to convert rotational movement of the rotational shaft into reciprocating movement, and wherein the cam reciprocates the open/close member relatively against the opening portion.

4. The developer supplying unit according to claim 1, wherein the open/close member is a drive transmitting portion to transmit driving to the conveying portion.

5. The developer supplying unit according to claim 1, further comprising:

a connecting member which is drive-connected to the open/close member;

a releasing member which releases a drive-connection between the connecting member and the open/close member; and a second cam which converts rotational movement of the output shaft into reciprocating movement, wherein the second cam reciprocates the releasing member between a release position where the drive-connection between the connecting member and the open/close member is released and a non-release position where the drive-connection between the connecting member and the open/close member is not released.

6. The developer supplying unit according to claim 5, wherein the releasing member is moved to the non-release position after the open/close member is moved to a connecting position to be drive-connected to the connecting member by rotating the output shaft in the reverse direction.

7. The developer supplying unit according to claim 5, wherein the open/close member is moved relatively against the opening portion from the closed position to the opened position after the open/close member is drive-connected to the connecting member by rotating the output shaft in the reverse direction.

* * * * *